United States Patent [19]

Dillard et al.

[11] 3,954,553

[45] May 4, 1976

[54] NON-SULFUR PULPING PROCESS FOR CORRUGATING MEDIUM USING SODIUM CARBONATE AND SODIUM HYDROXIDE

[75] Inventors: Byron M. Dillard, Lynchburg, Va.; Robert J. Gilmer, Valdosta, Ga.; John D. Kennedy, Lynchburg, Va.

[73] Assignee: Owens-Illinois, Inc., Toledo, Ohio

[22] Filed: June 13, 1974

[21] Appl. No.: 479,001

Related U.S. Application Data

[63] Continuation of Ser. No. 253,331, May 15, 1972, abandoned.

[52] U.S. Cl. ..... 162/90

[51] Int. Cl.[2] ..... D21C 3/02

[58] Field of Search ..... 162/86, 89, 90, 9, 27, 162/28

[56] References Cited

UNITED STATES PATENTS

| | | | |
|---|---|---|---|
| 51,568 | 12/1865 | Dixon | 162/90 |
| 1,795,754 | 9/1926 | Bradley et al. | 162/33 |
| 1,813,184 | 7/1931 | McQuistun et al. | 162/90 X |
| 1,829,378 | 10/1931 | Thirict | 162/90 X |
| 2,188,533 | 1/1940 | Drewson | 162/90 X |
| 2,694,631 | 11/1954 | Richter et al. | 162/85 X |
| 2,874,044 | 12/1955 | Wenzl | 162/90 |
| 2,904,460 | 9/1959 | Nolan | 162/28 X |
| 2,924,547 | 2/1960 | Knapp et al. | 162/83 |
| 3,003,909 | 10/1961 | Olson | 162/83 X |
| 3,309,262 | 3/1967 | Copeland et al. | 162/30 |
| 3,630,829 | 12/1971 | Caldwell | 162/90 X |
| 3,811,995 | 5/1974 | Ringley | 162/86 |

FOREIGN PATENTS OR APPLICATIONS

| | | | |
|---|---|---|---|
| 593,206 | 10/1947 | United Kingdom | 162/90 |
| 469,638 | 11/1950 | Canada | 162/90 |
| 579,306 | 7/1959 | Canada | 162/90 |

OTHER PUBLICATIONS

Abstract No. 3873, "Studies on Japanese Paper", p. 867, Institute of Paper Chem. Abstract Bulletin, Vol. 34, Feb. 1964.

*Pulping Processes*, Rhydholm, Interscience Publishers, N.Y., 1967, p. 683.

*Pulping Processes*, Rhydholm, Interscience N.Y., N.Y. 1967, p. 412.

*Primary Examiner*—S. Leon Bashore
*Assistant Examiner*—Steve Alvo

[57] ABSTRACT

A cooking liquor for the pulping of hardwoods which completely eliminates the use of all sulfur containing compounds is disclosed. The cooking liquor contains 15 to 50% of the total chemical as sodium hydroxide and 50 to 85% of the total chemical as sodium carbonate, the preferred liquor contains about 20% by weight of sodium hydroxide and 80% by weight of sodium carbonate. No adverse effect on the properties of the corrugating medium produced from such a liquor is observed when compared with the medium produced by the conventional neutral sulfite semichemical process.

3 Claims, 2 Drawing Figures

NON-SULFUR PULPING PROCESS FOR CORRUGATING MEDIUM USING SODIUM CARBONATE AND SODIUM HYDROXIDE

This is a continuation of application Ser. No. 253,331, filed May 15, 1972, now abandoned.

BACKGROUND OF THE INVENTION

One of the most widely used processes for preparing corrugating medium is the neutral sulfite semichemical process hereinafter referred to as the NSSC process. The cooking liquor in said process utilizes a molar ratio of sodium sulfite to sodium carbonate of from about 7 to 1 to about 3 to 1 which produces a pulping yield of about 65 to 80%. If desired, various buffers can be added such as sodium bicarbonate or sodium hydroxide although the bicarbonate is sometimes preferred since it does not darken the pulp as much as the hydroxide. An improvement on the NSSC process which uses much less sodium sulfite is disclosed in U.S. Pat. No. 3,003,909. A typical process suitable for making corrugated paperboard from hardwoods includes a ratio of sodium sulfite to sodium bicarbonate of 5 to 1, a concentration of liquor of 35 grams per liter, 14% of chemical on the basis of wood, a temperature of 170°C. at a pressure of 100 pounds per square inch for about 2 to 3 hours and a yield of 70%. However, the presence of the sulfur in the cooking liquor is very objectionable ecologically since the end products of the decomposition of liquors from the NSSC process include hydrogen sulfide and sulfur dioxide both of which are malodorous and corrosive thus tending to pollute the atmosphere.

Figure 1:
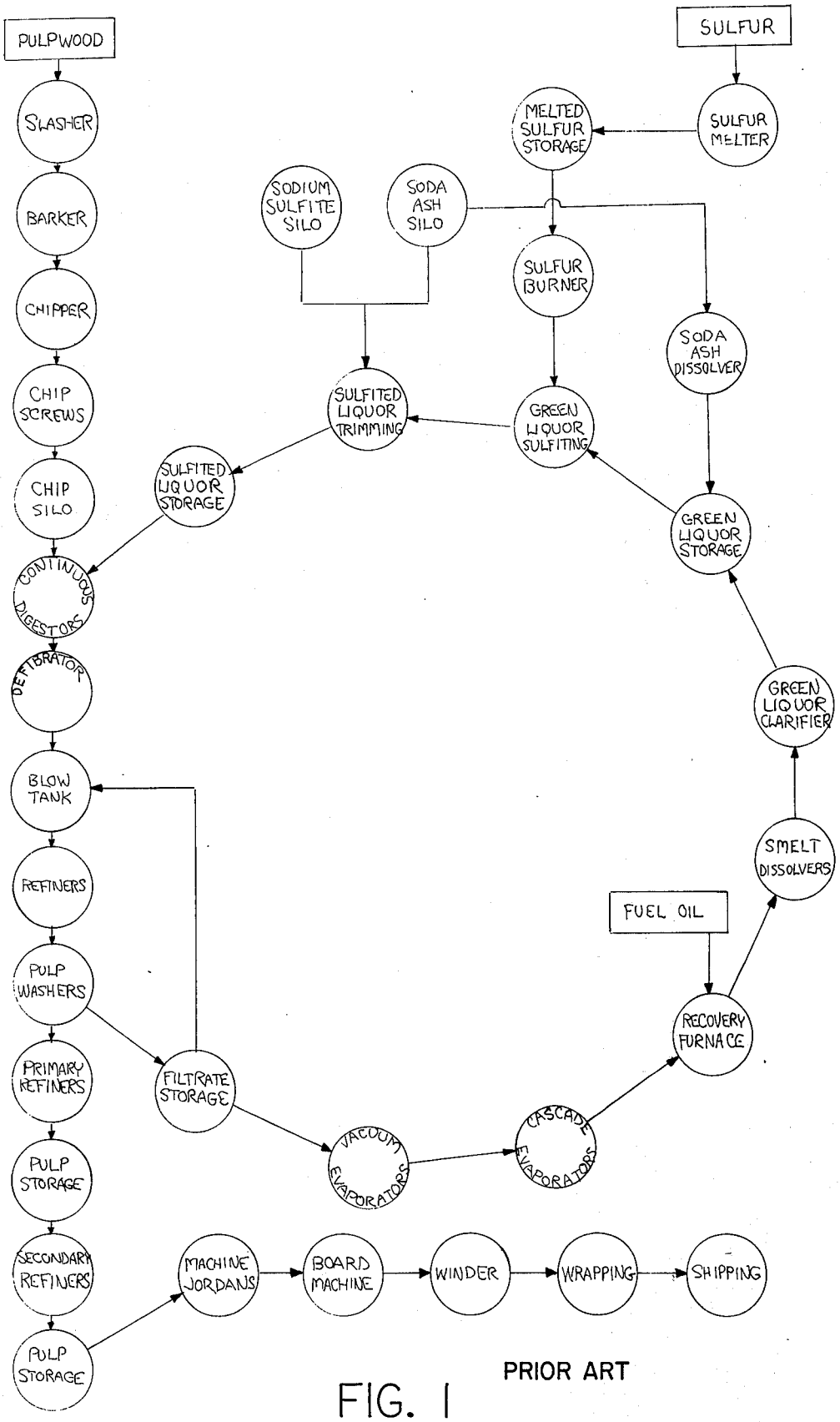
FIG. 1 PRIOR ART
FIG. 1 is a schematic process flow diagram for a present neutral sulfite corrugating medium mill. In such an operation, objectional sulfur compounds are lost to the atmosphere from the blow tank, the multiple effect evaporators, the cascade evaporators, the recovery furnace, and the green liquor sulfiting tower, as well as from various liquor tanks and effluent storage ponds.

U.S. Pat. No. 51,568 claims a process of treating wood by boiling it in sodium carbonate alone under pressure whereas Canadian Patent No. 569,638 uses sodium hydroxide alone as a pulping agent. In addition, a process employing pure caustic soda solution as a cooking medium for hardwood is described in Tappi, Vol. 36, No. 7, 294 (1953). The use of sodium carbonate alone results in slow pulping and requires much more chemical which is uneconomical whereas sodium hydroxide alone extracts more of the desirable hemicelluloses required for good corrugating medium.

It is the principal object of the present invention to provide a cooking liquor for pulping hardwoods which contains the proper balance of sodium carbonate and sodium hydroxide and which avoids the disadvantages hereinbefore set forth of using either component alone.

Another object is to provide a process which utilizes a liquor completely devoid of sulfur compounds and results in a pulp suitable for corrugating medium with physical properties equal to that obtained with neutral sulfite liquor but which eliminates the odor, corrosion and air and water pollution of present day processes.

Still another object is to provide a process which permits the simplification of the cooking liquor preparation and recovery system to give economies in both capital cost and operation.

A further object is to provide a process of increasing the speed of making paper by using a non-sulphur cooking liquor.

SUMMARY OF THE INVENTION

We have unexpectedly discovered that hardwoods can be pulped with an aqueous solution of sodium hydroxide and sodium carbonate to produce corrugating medium with properties equal to that produced by the NSSC process. The pulping is dependent upon a temperature of about 375°F. at a pressure of about 180 pounds per square inch with a cook time of 5 minutes or equivalent time-temperature relationships. The chemical to oven dry wood charge is normally 4.5% by weight but can be varied from 3 to 10% by weight expressed as sodium oxide. The concentration of the cooking liquor is 100 grams per liter of active NaOH and $NaCO_3$ wherein the hydroxide may vary from 8 to 20 grams per liter and the carbonate may vary from 80 to 92 grams per liter as $Na_2O$.

There are several advantages which accrue when sulfur is removed from the pulping system including the following:

1. Water removal on the paper machine is improved to the extent of about 5% as a result of using the claimed process with a corresponding reduction in steam usage.
2. Total pulping chemical usage is reduced. The prior art NSSC process required an average pulping addition of 6% chemical as $Na_2O$ based on oven dried chips whereas the claimed process requires only 4.5% total chemicals on the same basis.
3. The load on mill evaporators is decreased by 23%.
4. Pulp yield is increased 1.8% from a given quantity of wood.
5. Recovery furnace smelt is much less sensitive so smelt-water reactions in that there is a noticeable reduction in intensity of dissolving tank "bumps".
6. All unpleasant odors from the sulfur containing compounds formed by the NSSC process are eliminated from the mill and surrounding areas.
7. Aqueous effluent problems are reduced because of the absence of sulfur containing reducing agents in spent liquors, and
8. The removal of sulfur from the pulping system eliminates dreg formation and disposal problems connected therewith.

Figure 2:
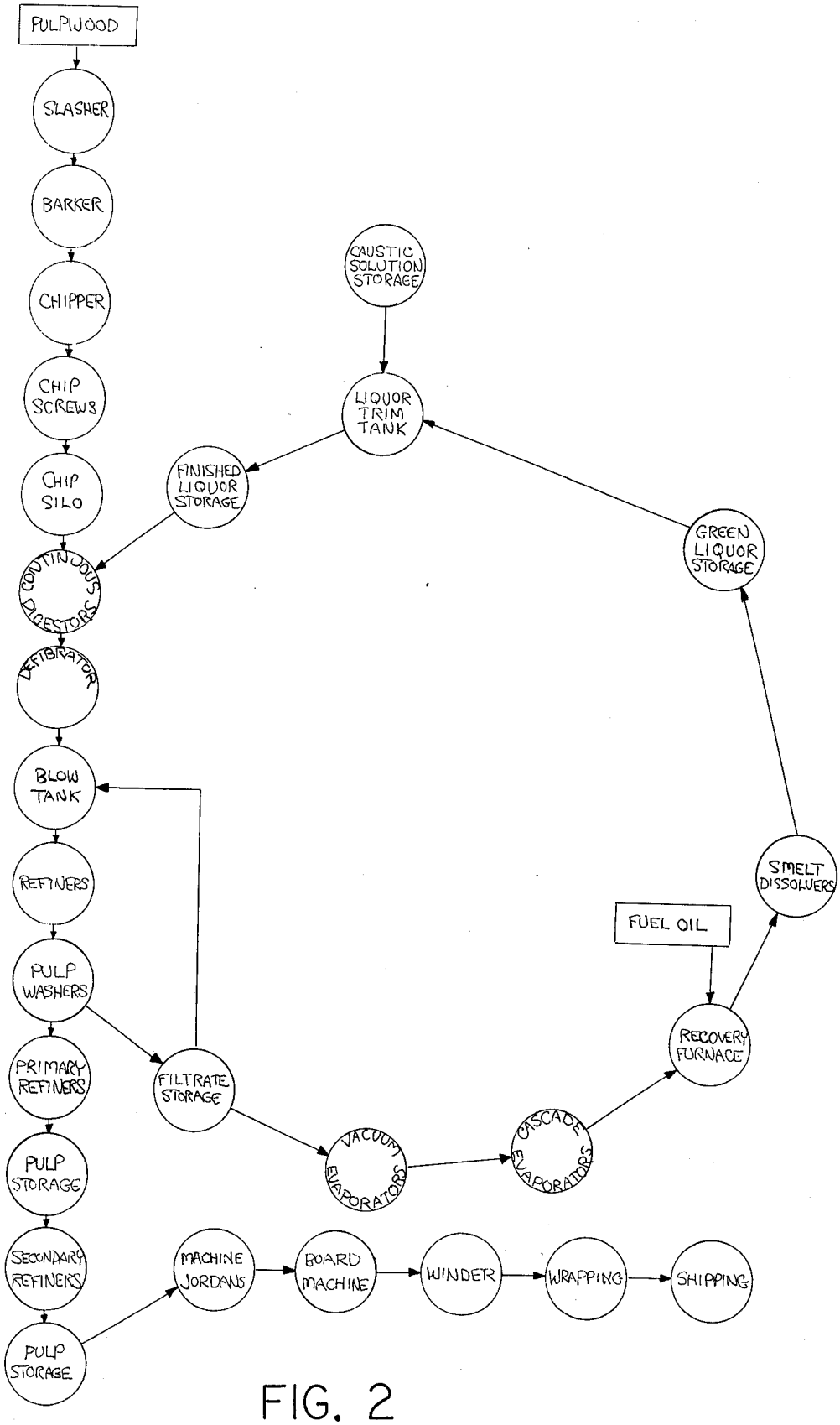
FIG. 2 is a schematic process flow diagram of the new process.

FIG. 2 is a schematic process flow diagram of the new system for a carbonate-hydroxide corrugating medium mill.

In such a mill, it is possible to eliminate the sulfur burner and the green liquor sulfiting tower as well as all handling and storage of sulfur now needed for neutral sulfite corrugating medium as shown in FIG. 1. It is also possible to eliminate the green liquor clarifier and sodium sulfite storage, as well as the soda ash storage silo and dissolving tank with consequent appreciable savings in capital investment for a new mill. Likewise, stainless steel may be replaced with plain steel in most liquor contact areas with further capital savings. In addition, in a new installation instead of the cascade evaporators and recovery furnaces a less costly fluidized bed can be used to burn the spent liquor and to convert the inorganic content to sodium carbonate for recycle to the pulping process. This is not practical when sulfite is used in cooking because under the oxidizing conditions of combustion in such a fluid bed, sodium sulfate is produced which is not suitable for pulping.

The system as shown in FIG. 2 releases no obnoxious sulfur compounds from any step, thus eliminating the air pollution which is characteristic of the present neutral sulfite process.

As indicated in FIG. 2, a caustic solution of sodium hydroxide is desirably supplied as the make up chemical for the process. However, this sodium hydroxide could also be purchased in solid form, or alternatively could be prepared by causticizing new or recovered sodium carbonate. In the latter case, sodium carbonate may be used as the make up chemical instead of sodium hydroxide.

DESCRIPTION OF THE PREFERRED EMBODIMENTS

EXAMPLES 1–5

The following examples illustrate the pulping of hardwoods using cooking liquors containing various amounts of sodium hydroxide and sodium carbonate and the effect of such liquors on the properties of the corrugating medium thus produced compared with the standard NSSC process. The chemical content of the cooking liquor used in the standard process contained 70% by weight of sodium carbonate, 22% by weight of sodium sulfite and 8% by weight of sodium sulfide all based on $Na_2O$. Each cook consisted of 2000 grams of hardwood chips on an oven dried basis which were treated with 7% by weight of total chemical expressed as $Na_2O$. The liquid/wood ratio was 4/1. The cook was heated to 340°F. within 50 minutes and held at that temperature for 45 minutes. The cooked chips were then run through a laboratory disc refiner at 10 mil plate clearance to defiber them. The resulting pulp was refined in a laboratory refiner and converted into handsheets and tested by standard procedures. The strength properties of the sheets were as follows wherein CMT means corrugating medium test, OH means sodium hydroxide and $CO_3$ means sodium carbonate, expressed as $Na_2O$.

| % by Wt. OH to $CO_3$ | Ring Crush | Tear | Tensile | CMT | Yield % |
|---|---|---|---|---|---|
| Standard | 55.3 | 70 | 26.1 | 40.0 | 76.4 |
| Standard | 55.0 | 68 | 27.5 | 46.0 | 77.5 |
| Standard | 56.5 | 60 | 28.2 | 45.0 | 71.1 |
| Standard | 60.4 | 68 | 26.0 | 50.5 | 76.8 |
| Average | 56.8 | 67 | 27.0 | 45.4 | 75.5 |
| 50 – 50 | 56.5 | 74 | 24.3 | 47.7 | 74.2 |
| 50 – 50 | 53.6 | 74 | 25.5 | 47.8 | 73.5 |
| Average | 55.1 | 74 | 24.9 | 47.8 | 73.9 |
| 40 – 60 | 48.5 | 67 | 25.7 | 39.9 | 74.0 |
| 40 – 60 | 51.0 | 67 | 25.5 | 40.6 | 75.0 |
| Average | 49.3 | 67 | 25.6 | 40.3 | 74.5 |
| 30 – 70 | 56.0 | 72 | 26.6 | 43.0 | 75.8 |
| 30 – 70 | 54.5 | 76 | 27.0 | 42.0 | 75.4 |
| Average | 55.3 | 74 | 26.8 | 42.5 | 75.6 |
| 20 – 80 | 53.4 | 67 | 25.5 | 50.8 | 74.0 |
| 20 – 80 | 56.4 | 66 | 19.4 | 42.8 | 75.6 |
| Average | 54.9 | 67 | 22.5 | 46.8 | 75.1 |

In the above table, ring crush is expressed in lbs/6 inches, tear in grams per 16 sheets, tensile in lbs/1 inch width and CMT in lbs/10 flutes.

It is apparent from the foregoing data that the yield and physical properties of the corrugating medium are not significantly affected when a non-sulfur pulping agent is used compared to the standard NSSC cooking liquor. However, lower amounts of sodium hydroxide (about 20%) and higher amounts of sodium carbonate (about 80%) are preferred.

EXAMPLES 6–7

In these examples, the NSSC process was again used as the standard and compared to a cooking liquor the chemical content of which may be expressed as consisting of 20% by weight of sodium hydroxide and 80% by weight of sodium carbonate based on $Na_2O$. Each cook consisted of 2000 grams of hardwood chips on an oven dried basis which were treated with 7% by weight of total chemical (as $Na_2O$). The liquid to wood ratio was 6 to 1 and the cooks were heated to 380+F within 3 minutes, then held at that temperature for 3 minutes. The cooked chips were processed as described in the preceding examples and converted into handsheets. The strength properties of the sheet are shown in the table below.

| Cook Type | Ring Crush | Tear | Tensile | CMT | Yield % |
|---|---|---|---|---|---|
| Standard Hydroxide | 51.6 | 66 | 25.7 | 38.5 | 77.0 |
| Carbonate | 48.8 | 68 | 22.9 | 36.0 | 78.2 |

The above data show that the yield with the claimed non-sulfur process may be somewhat higer but that the properties of the corrugating medium produced may be slightly lower compared with the standard NSSC process on a laboratory scale.

EXAMPLES 8–9

In actual mill runs, hardwood chips were pulped in Pandia continuous digesters utilizing 175 pounds per square inch gauge of steam pressure, a temperature of 376°F. and a cooking time of 4 to 6 minutes. The total chemical charge based on $Na_2O$ was 4.5% by weight of a cooking liquor containing 15% sodium hydroxide and 85% sodium carbonate or 8 grams per liter of hydroxide and 44.5 grams per liter of carbonate expressed as $Na_2O$. This cooking liquor was compared with that employed in the standard NSSC process in which the chemical charge into the digesters was 6 to 10% by weight on the basis of $Na_2O$.

The wood chips were cooked in the digesters and then refined in a series of pulp refiners which separated the fibers and shortened the fiber lengths until the pulp was suitable for formation into paper on a fourdrinier paper machine. After two stages of this refining, the spent cooking liquor commonly known as black liquor was washed from the pulp on rotary drum vacuum washers. The black liquor was then concentrated by evaporation and burned in a smelting furnace. The molten ash from the furnace was dissolved in water to form green liquor which was essentially a sodium carbonate solution when the hydroxide-carbonate cook was used. The green liquor was fortified with sodium hydroxide to form the cooking liquor for use in the digesters thus completing the liquor recovery cycle. Pulp produced by the claimed hydroxide-carbonate process was converted to corrugating medium, 26 pounds per thousand square feet, and a strength properties compared with similar corrugating medium prepared by the NSSC process. The average results from several months of mill operation are tabulated below:

| Cook Type | Ring Crush | CMT | Tear in g/16 Sheets Machine Direction | Cross Direction |
|---|---|---|---|---|
| Standard Hydroxide | 40 | 70.7 | 48 | 65 |
| Carbonate | 43 | 70.3 | 50 | 67 |

The above figures clearly show that corrugating medium prepared by the new processes equal or better physical strength properties compared to that produced by the standard NSSC process. In addition, the mill runs unexpectedly showed all the advantages previously set forth namely, about a 2% increase in yield, lower chemical usage, lack of obnoxious odors and increased production speed.

If desired, other alkali metal hydroxides and carbonates can be substituted for the sodium compounds employed in the present invention. However, sodium hydroxide and sodium carbonate are preferred for economic reasons.

We claim:

1. In the process for pulping hardwoods to produce pulp for corrugating medium wherein hardwood chips are cooked in an aqueous cooking liquor at elevated temperatures and pressures to penetrate and soften the chips, and the resulting softened chips are defibered to form said pulp for corrugating medium, the improvement wherein said chips are cooked in a sulfur free aqueous solution containing from about 15 to 50% of the total chemical as sodium hydroxide and 50 5o 85% of the total chemical as sodium carbonate both expressed as sodium oxide wherein the chemical to oven dry wood charge is from about 3 to 10% by weight expressed as sodium oxide at a temperature and for a time equivalent to the range of conditions between:

cooking at 376°F for 4 minutes, and heating to 340°F in 50 minutes followed by cooking at 340°F for 45 minutes.

2. The process of claim 1 wherein said cooking is carried out at a temperature of about 376°F for about 4 minutes to about 6 minutes.

3. The process of claim 1 wherein said aqueous solution contains about 20% by weight of total chemical as sodium hydroxide and 80% by weight of total chemical as sodium carbonate both expressed as sodium oxide.

* * * * *

UNITED STATES PATENT OFFICE

CERTIFICATE OF CORRECTION

PATENT NO. : 3,954,553

DATED : May 4, 1976

INVENTOR(S) : BYRON M. DILLARD, JOHN D. KENNEDY and ROBERT J. GILMER

It is certified that error appears in the above-identified patent and that said Letters Patent are hereby corrected as shown below:

Col. 1, line 45,"569,638" should be --469,638--. Col. 2, line 18, "$NaCO_3$" should be --$Na_2CO_3$--. Col. 4, line 14, "380+F" should be --380°F--. Col. 6, line 9 of claim 1, "50 5o 85%" should be --50 to 85%--.

Signed and Sealed this

Twenty-eighth Day of September 1976

[SEAL]

*Attest:*

RUTH C. MASON
*Attesting Officer*

C. MARSHALL DANN
*Commissioner of Patents and Trademarks*